US005576679A

United States Patent [19]

Ohashi et al.

[11] Patent Number: 5,576,679

[45] Date of Patent: Nov. 19, 1996

[54] CYLINDRICAL PERMANENT MAGNET UNIT SUITABLE FOR GYROTRON

[75] Inventors: Ken Ohashi; Takeo Takada, both of Fukui; Toshiyuki Kikunaga, Hyogo, all of Japan

[73] Assignees: Shin-Etsu Chemical Co., Ltd.; Mitsubishi Denki Kabushiki Kaisha, both of Tokyo, Japan

[21] Appl. No.: 547,343

[22] Filed: Oct. 24, 1995

[30] Foreign Application Priority Data

Oct. 25, 1994 [JP] Japan ..... 6-284132

[51] Int. Cl.[6] ..... H01F 7/02

[52] U.S. Cl. ..... 335/306

[58] Field of Search ..... 335/296–306; 324/318–320

[56] References Cited

U.S. PATENT DOCUMENTS

| | | | |
|---|---|---|---|
| 3,237,059 | 2/1966 | Meyerer | 335/306 |
| 4,703,276 | 10/1987 | Beer | 324/319 |
| 4,720,692 | 1/1988 | Jin | 333/144 |
| 5,014,032 | 5/1991 | Aubert | 335/306 |
| 5,148,138 | 9/1992 | Miyata | 335/302 |

FOREIGN PATENT DOCUMENTS 56-102045 8/1981 Japan .

*Primary Examiner*—Brian W. Brown
*Assistant Examiner*—Raymond M. Barrera
*Attorney, Agent, or Firm*—Lowe, Price, LeBlanc & Becker

[57] ABSTRACT

The invention provides a cylindrical permanent magnet unit suitable for application to gyrotrons. Essentially the magnet unit consists of two cylindrical permanent magnets which are coaxially aligned, and there is a space between the two cylindrical magnets. Each of the two cylindrical magnet is a coaxially juxtaposed assembly of a plurality of ring-like permanent magnets, and each ring-like magnet is constructed of a plurality of permanent magnet segments. In one of the two cylindrical magnets every ring-like permanent magnet is magnetized in radial directions from the inside toward the outside, and in the other every ring-like permanent magnet is magnetized in radial directions from the outside toward the inside. In the bore of the cylindrical magnet unit the magnetic field is in the direction of the longitudinal center axis of the bore. By virtue of the space between the two cylindrical magnets, the distribution of flux density in the direction of the center axis becomes flat in a middle section of the bore. A ring-like member of a non-magnetic material may be inserted in the aforementioned space.

24 Claims, 8 Drawing Sheets

CYLINDRICAL PERMANENT MAGNET UNIT SUITABLE FOR GYROTRON

BACKGROUND OF THE INVENTION

This invention relates to a cylindrical permanent magnet unit for producing a magnetic field in the direction of the longitudinal axis of the cylindrical unit within the bore of the cylindrical unit. Essentially the cylindrical magnet unit is an assembly of a plurality of ring-like permanent magnets magnetized in radial directions. The cylindrical magnet unit is suitable for application to gyrotrons and some other electron tubes such as gyro-travelling-wave tubes.

A gyrotron is an electron tube to generate a microwave by utilizing maser effects of cyclotron resonance. In a gyrotron a tubular beam of electrons interacts with an electromagnetic field in a resonant cavity, and the interaction results in conversion of the kinetic energy of electrons into electromagnetic energy and generation of a high-frequency wave. Known gyrotrons include gyromonotrons having a single resonant cavity and gyroklystrons having a plurality of resonant cavities to accomplish amplification of high-frequency waves.

For instance, JP-A 56-102045 shows a gyrotron apparatus with a single resonant cavity. The gyrotron has an electron gun at one end of a tubular body of the apparatus, and a middle section of the tubular body provides a resonant cavity. Outside of the tubular body, a cylindrical electromagnet surrounds the electron gun, and another cylindrical electromagnet surrounds the resonant cavity. In the bore of the tubular body a magnetic field in the direction of the longitudinal center axis of the bore is produced by the two electromagnets. The electrons drifting from the electron gun are affected by the magnetic field and make spiral motion, while the electrons form a tubular beam. The magnetic flux density in the gyrotron body gradually increases from the end section where the electron gun is positioned toward the resonant cavity. In the resonant cavity the distribution of flux density should be flat in the direction of the center axis. The arrangement of the two electromagnets and the magnet excitation currents are determined so as to realize the desired distribution of flux density.

The two electromagnets in the gyrotron apparatus are normal conductivity magnets or superconducting magnets, or a combination of a normal conductivity magnet and a superconducting magnet. In the resonant cavity a very strong magnetic field is needed for oscillation at a very high frequency. Usually normal conductivity magnets are used for oscillation at frequencies below about 30 GHz and superconducting magnets for oscillation at higher frequencies.

Superconducting magnets are generally very costly, and for excitation the magnets must be cooled to a very low temperature by using either a refrigerant such as liquid helium or a high-performance refrigirating apparatus. Besides, it is difficult to quickly vary the strength of a magnetic field produced by a superconducting magnet. Normal conductivity magnets for producing a very strong magnetic field need power supplies of very large capacity for excitation and consume very large power. Besides, it is necessary to cool the electromagnets and power supplies.

SUMMARY OF THE INVENTION

It is an object of the present invention to provide a cylindrical permanent magnet unit, which is suitable for application to gyrotrons and advantageous over conventional electromagnets particularly in respect of the ease of gyrotron operation and lowness of operation cost.

A cylindrical permanent magnet unit according to the invention comprises a first cylindrical permanent magnet which is an assembly of a plurality of coaxially juxtaposed ring-like permanent magnets each of which is magnetized in approximately radial directions from the inside toward the outside, a second cylindrical permanent magnet which is an assembly of a plurality of coaxially juxtaposed ring-like permanent magnets each of which is magnetized in approximately radial directions from the outside toward the inside. The first and second cylindrical permanent magnets are longitudinally aligned to have a common center axis and to provide a space between the first and second cylindrical magnets. Each of the ring-like permanent magnet of the first and second cylindrical magnets is constructed of a plurality of segments arranged around a circumference, and each of the segments is a permanent magnet magnetized in an approximately radial direction with respect to the aforementioned circumference.

This cylindrical permanent magnet unit produces a magnetic field which is in the direction of the longitudinal center axis in the bore of the cylindrical unit. The space between the first and second cylindrical permanent magnets serves the purpose of flattening the distribution of flux density in the direction of the center axis of the cylindrical magnet unit in a middle section of the unit. The manner of distribution of flux density throughout the bore of the cylindrical magnet unit depends on the arrangement, configurations and magnetic characteristics of the ring-like permanent magnets which constitute the two cylindrical permanent magnets. A plurality of permanent magnet segments are used to form each ring-like permanent magnet because it is impossible to magnetize a unitary ring magnet in radial directions.

In the practice of the present invention, the first and second cylindrical permanent magnets are not necessarily literally "cylindrical". That is, in cross-sections the "cylindrical" magnets may be polygonal (usually with at least 8 sides) on the outside and/or inside. Accordingly, in cross-sections any of the ring-like magnets which constitute the cylindrical magnets may be polygonal on the outside and/or inside.

In this invention it is an option to insert a ring-like member of a nonmagnetic material in the space between the two cylindrical permanent magnets. Another option is to insert a ring-like permanent magnet magnetized in a direction parallel to the center axis of the cylindrical magnet unit in the aforementioned space.

Furthermore, it is possible to minutely adjust the distribution of flux density in the cylindrical magnet unit by providing some or all of the ring-like permanent magnets with a mechanical means for slightly moving the magnet segments in radial directions. For the same purpose it is also possible to adjustably insert small pieces of either a ferromagnetic material or a permanent magnet into some or all of the ring-like permanent magnets.

A cylindrical permanent magnet unit according to the invention is suitable for application to gyrotrons. The permanent magnet unit needs neither a power supply nor a cooling system. Therefore, it is possible to reduce the overall size of a gyrotron apparatus, and the maintenance and operation of gyrotron apparatus become very simple and easy with a substantial reduction of costs. Furthermore, it is easy to realize a desired pattern of the distribution of flux density in the gyrotron apparatus.

DESCRIPTION OF THE PREFERRED EMBODIMENTS

Figure 1:
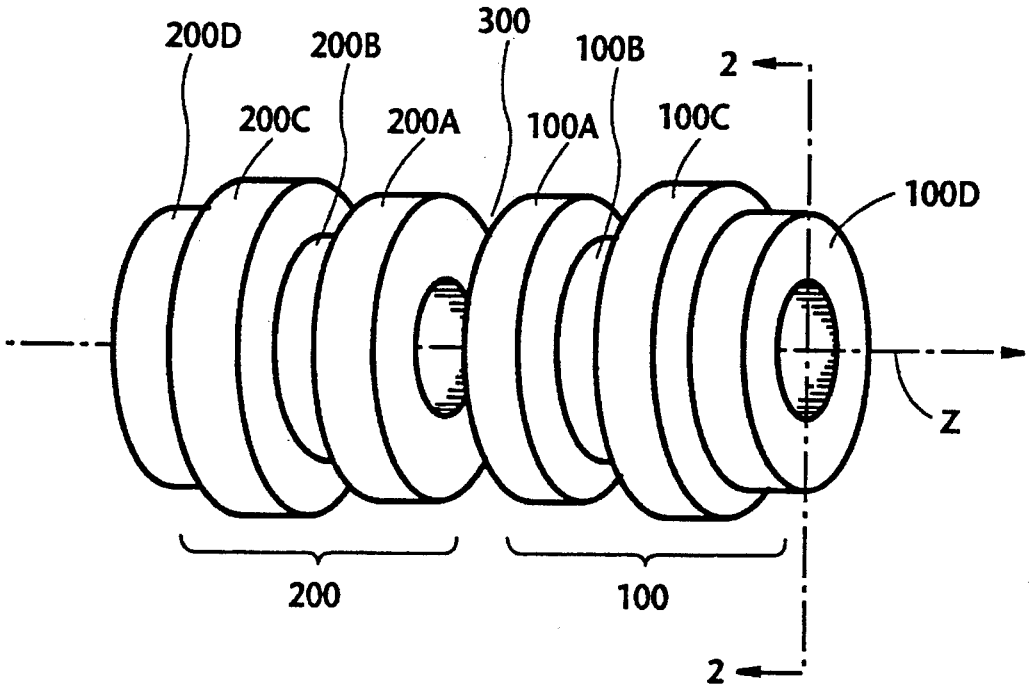
FIG. 1 shows, in a perspective view, the fundamental construction of a cylindrical magnet unit according to/the invention.
Figure 2:
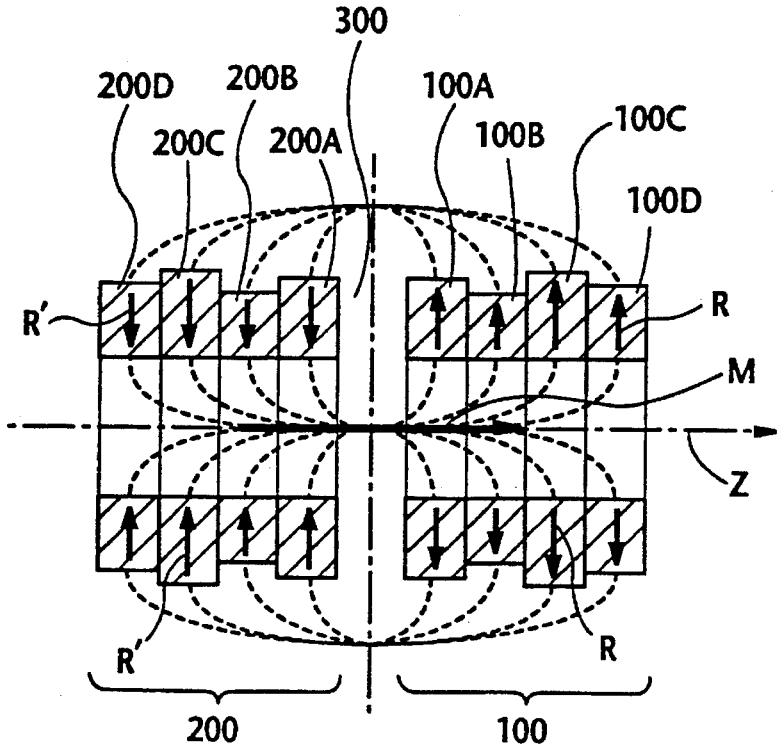
FIG. 2 is a sectional view taken along the line 2—2 in FIG. 1.

FIGS. 1 and 2 show the fundamental construction of a cylindrical magnet unit 10 according to the invention. The magnet unit 10 consists of first and second cylindrical permanent magnets 100 and 200 which are aligned to have a common center axis Z, and there is a space 800 between the two cylindrical magnets 100 and 200. The first cylindrical magnet 100 is an assembly of a plurality of ring-like permanent magnets 100A, 100B, 100C, 100D in a coaxically juxtaposed arrangement. In the same manner the second cylindrical magnet 200 is an assembly of a plurality of ring-like permanent magnets 200A, 200B, 200C, 200D. In each of the two cylindrical magnets 100 and 200 shown in FIGS. 1 and 2, the constituent ring-like magnets 100A–100D or 200A–200D have the same thickness, the same inner diameter and unequal outer diameters, but these are not essential conditions. The ring-like magnets 100A–100D or 200A–200D may have unequal thicknesses and/or unequal inner diameters, and/or may have the same outer diameter. The first and second cylindrical magnets 100 and 200 are not necessarily symmetrical as illustrated.

Referring to FIG. 2, in the first cylindrical magnet 100 every ring-like magnet 100A–100D is magnetized in radial directions indicated by arrows R, i.e. in directions approximately perpendicular to the center axis Z from the inside of the ring-like magnet toward the outside. In the second cylindrical magnet 200 every ring-like magnet 200A–200D is magnetized in the opposite directions indicate by arrows R', i.e. in radial directions from the outside of the ring-like magnet toward the inside. Therefore, a magnetic field in the direction of the center axis Z, indicated by arrow M, is produced in the hole of the cylindrical magnet unit 10 constructed of the first and second cylindrical magnets 100 and 200. In FIG. 2 the broken lines represent the flux lines. The space 300 between the two cylindrical magnets 100 and 200 serves the purpose of flattening the strength distribution of the magnetic field M along the center axis Z in a middle section of the cylindrical magnet unit 10. The length of the space 300 along the center axis Z is determined with consideration of various factors such as the size of the cylindrical magnet unit 10, sizes of the respective ring-like magnets 100A–200D and the magnet materials of the ring-like magnets.

Figure 3:
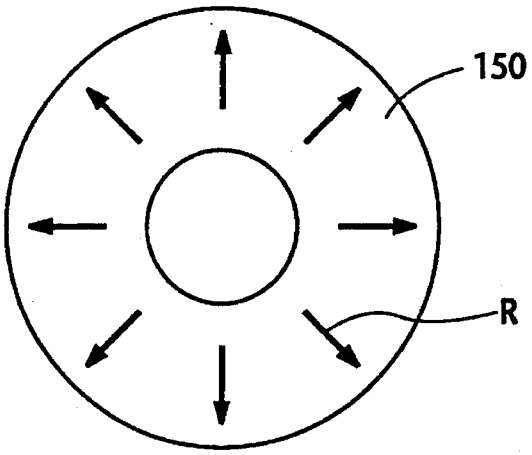
FIG. 3 is a plan view of a ring-like permanent magnet supposed to be magnetized in radial directions.

FIG. 3 shows a suppositional ring-like permanent magnet 150 which is a unitary magnet body magnetized in radial directions R, but actually it is impossible to magnetize a ring magnet in this manner.

Figure 4:
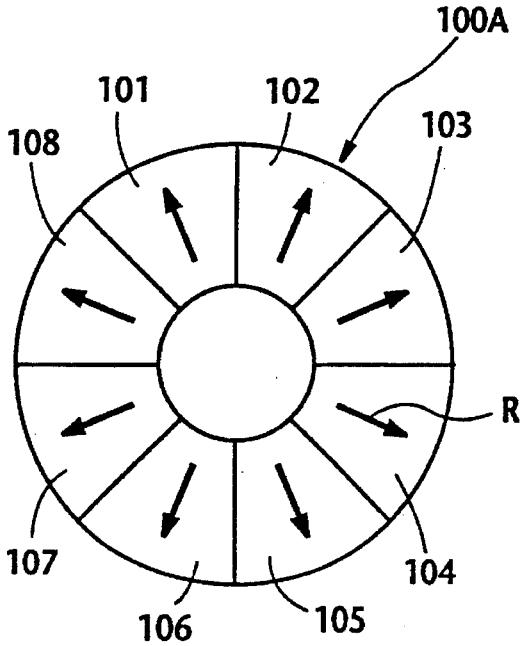
FIG. 4 is a plan view of a ring-like permanent magnet which is an assembly of a plurality of magnet segments and is used in the cylindrical magnet unit of FIG. 1.

Therefore, each of the ring-like permanent magnets 100A–200D in the cylindrical magnet unit 10 is an assembly of a plurality of segments each of which is a permanent magnet block. For example, FIG. 4 shows that the ring-like magnet 100A is a circumferential assembly of eight sector-like segments 101, 102, . . . , 108. These segments are permanent magnet blocks, and they are individually magnetized in the direction R before being assembled into the ring-like magnet 100A.

Figure 5:
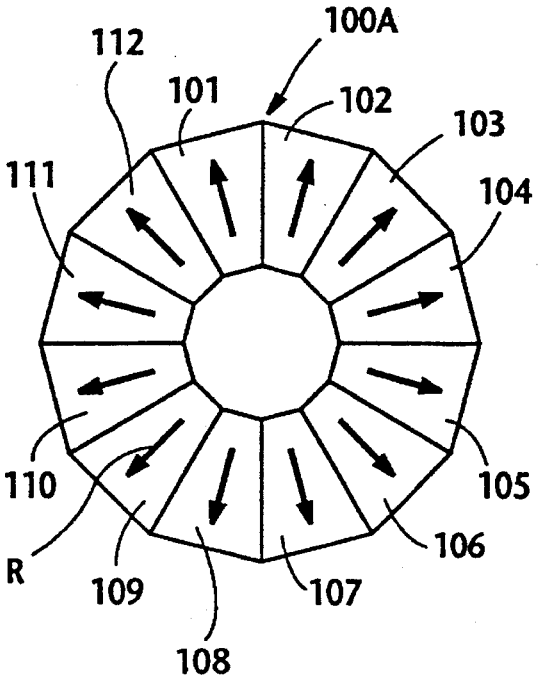
FIG. 5 shows a modification of the configuration of the ring-like magnet of FIG. 4.

As mentioned hereinbefore, ring-like permanent magnets in the present invention may be polygonal on the outside and/or inside. Referring to FIG. 5, if the ring-like magnet 100A (for example) is polygonal on the outside and inside, a plurality of trapezoidal segments 101, 102, . . . , 112 are assembled in a circumferential arrangement. These segments 101–112 are permanent magnet blocks which are individually magnetized in the direction R before the assembling.

Figure 6A:
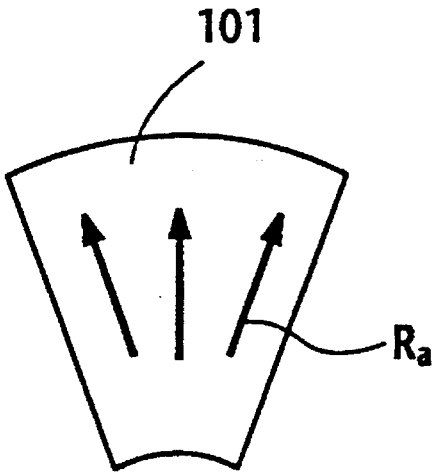
FIG. 6(A) shows ideal directions of magnetization of each segment of the ring-like magnet of FIG. 4.
Figure 6B:
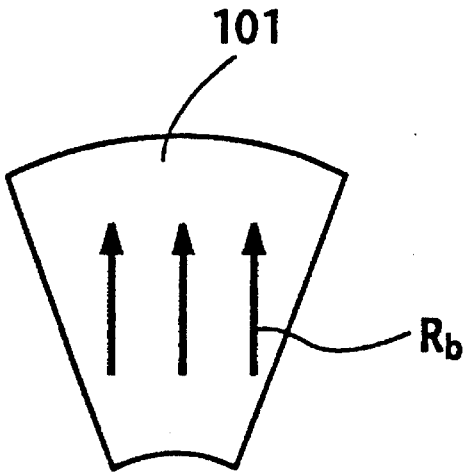
FIG. 6(B) shows the actual direction of magnetization of the same segment.
Figure 7A:
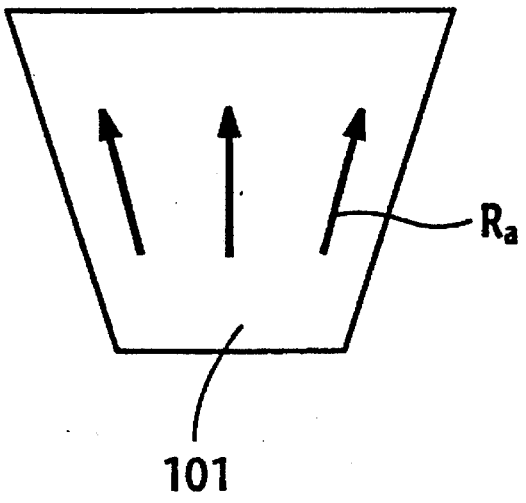
FIG. 7(A) shows ideal directions of magnetization of each segment of the ring-like magnet of FIG. 5.
Figure 7B:
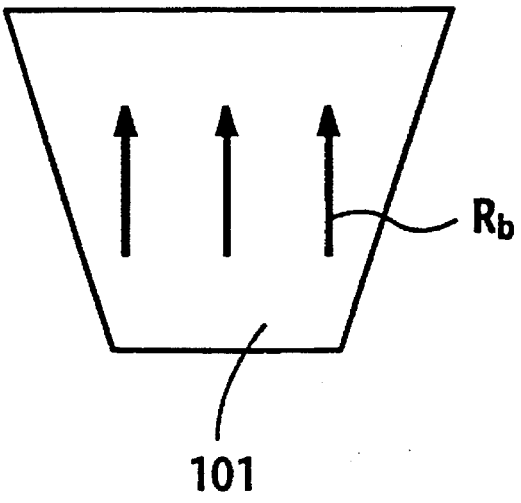
FIG. 7(B) shows the actual direction of magnetization of the same segment.

Referring to FIG. 6(A), in producing each sector-like segment (for example, segment 101 in FIG. 4) of each ring-like magnet it is desirable to orient magnetic domains accurately in radial directions as indicated by arrows $R_a$, but in practice this is very difficult. Therefore, usually magnetic domains of the magnet segment 101 are uniformly oriented in a direction parallel to a radius, as indicated by arrows $R_b$ in FIG. 6(B). Also it is desirable but very difficult to orient magnetic domains of a trapezoidal magnet segment (for example, segment 101 in FIG. 5) in the directions indicated by arrows $R_a$ in FIG. 7(A), and hence usual orientation of this magnet segment is in the direction indicated by arrows $R_b$ in FIG. 7(B).

In each of the two cylindrical magnets 100 and 200, the ring-like magnets 100A–100D or 200A–200D are usually tightly juxtaposed to leave no gap between the adjacent ring-like magnets with a view to augmenting the strength of the intended magnetic field. However, it is optional to leave a narrow gap, or insert a thin plate of a nonmagnetic material, between any of the ring-like magnets 100A–100D or 200A–200D and an adjacent ring-like magnet for the purpose of desirably adjusting the distribution of flux density in the hole of the cylindrical magnet 100 or 200.

Figure 15:
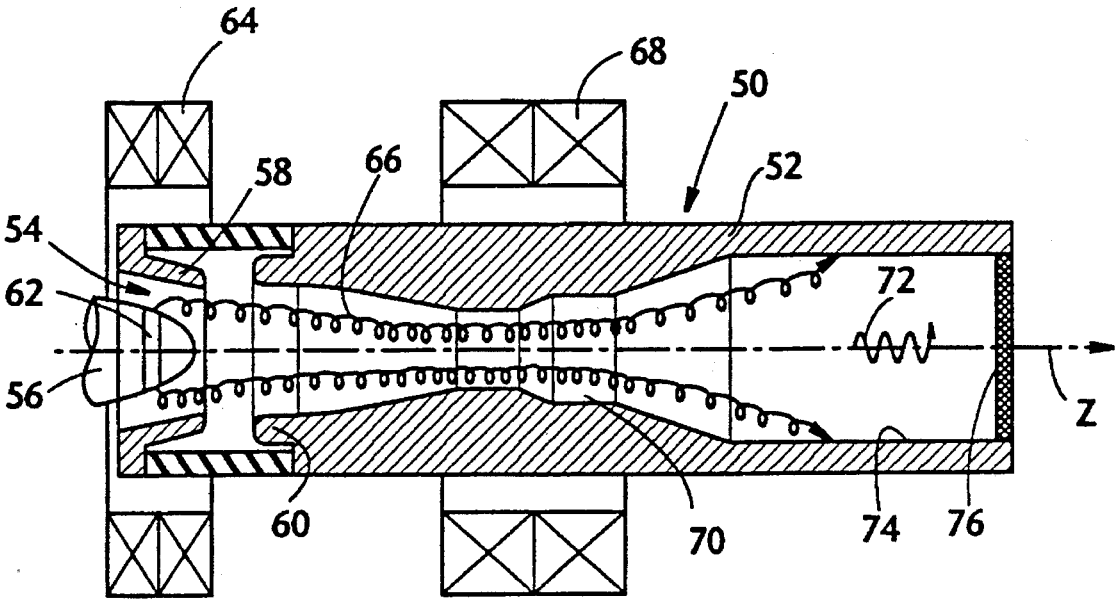
FIG. 15 PRIOR ART
FIG. 15 is a schematic sectional view of a gyrotron apparatus using conventional electromagnets.

FIG. 15 shows a gyrotron apparatus 50 using conventional electromagnets. At one end of a tubular body 52 of the gyrotron there is an electron gun 54 having a cathode 56, first anode 58, second anode 60 and an electron emitting part 62 on the cathode 56, and a cylindrical electromagnet 64 surrounds the electron gun 54. A middle section of the bore of the gyrotron body 52 provides a resonant cavity 70. Outside of the body 52, a cylindrical main electromagnet 68 surrounds the resonant cavity 70. The two electromagnets 68 and 64 produce a magnetic field in the direction of the center axis Z of the gyrotron body 52. By the influence of the magnetic field, electrons emitted from the electron gun makes spiral motion and form a tubular beam 66. In the resonant cavity 70 a high-frequency electromagnetic wave 72 is generated by resonant interaction of the electron beam 66 with a high-frequency electromagnetic field. After the interaction the electron beam is collected in a collector section 74, and the high-frequency electromagnetic wave 72 is taken out of the gyrotron body 52 through an output window 76.

Figure 16:
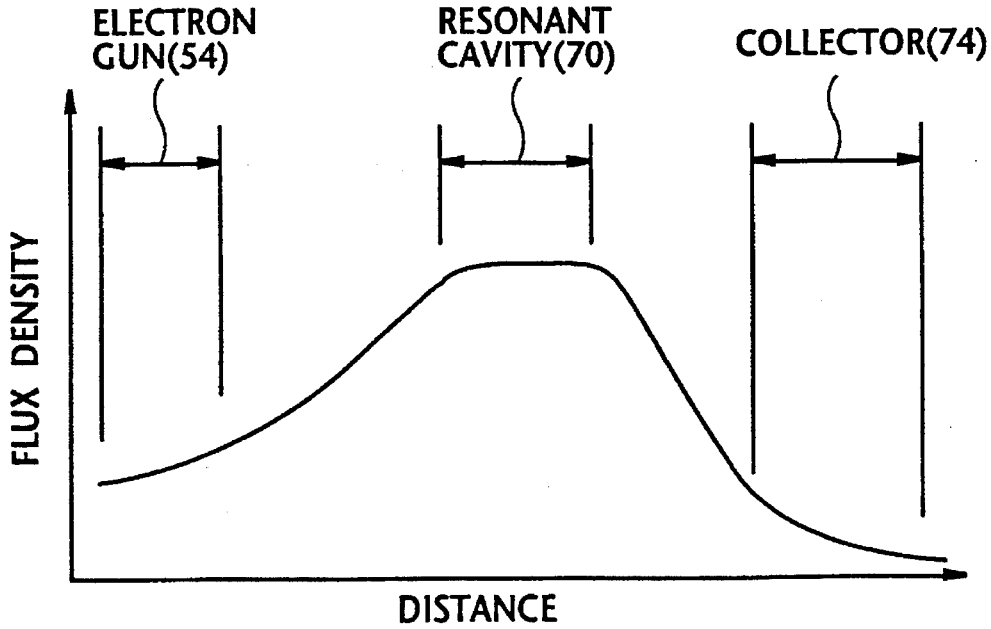
FIG. 16 is a chart showing the distribution of flux density in the gyrotron apparatus of FIG. 15 along the longitudinal center axis of the apparatus.

FIG. 16 shows the distribution of magnetic flux density in the gyrotron body 52 along the center axis Z. In the resonant cavity 70 flat distribution of flux density is required, and the uniformity of the magnetic field must be better than about 0.5%. In the end section where the electron gun 54 is positioned and also in the collector section 74, a relatively mild gradient of the flux density is desired. The arrangement of the two electromagnets 64 and 68 and the magnet exciting currents are determined so as to meet the above conditions.

The electron beam emitted from the part 62 of the electron gun 54 is accelerated by an electric field produced between the cathode 56 and the second anode 60 and travels toward the resonant cavity 70 while making spiral motion by the influence of the magnetic field produced by the electromagnet 64. As the flux density gradually augments toward the resonant cavity 70, the electron beam 66 is compressed. Therefore, the velocity of the electron beam in the directions perpendicular to the magnetic field increases while the velocity in the direction parallel to the magnetic field decreases. In the resonant cavity 70 the spiral or cyclotronic motion of the electrons is augmented by the magnetic field (in the direction of the axis Z) produced by the main electromagnet 68, and there occurs resonant interaction (called cyclotron resonance maser) between the electron beam and a high-frequency electromagnetic field which depends on the natural mode of the resonant cavity (cavity resonator). As a result the energy of the electron beam attributed to the velocity component perpendicular to the magnetic field is partly converted into high-frequency electromagnetic energy. After that the electron beam gradually increases its diameter as the flux density gradually lowers as shown in FIG. 16 and is absorbed in the collector section 74.

In the resonant cavity 70 the energy of the electron beam is efficiently converted into high-frequency electromagnetic energy when the following equations (1) and (2) hold.

$$\omega - K_z V_z \geqq s\Omega_c \tag{1}$$

where $\omega$ is the resonant angular frequency of the electromagnetic field depending on the natural mode of the cavity resonator, $K_z$ is the natural mode wave number in the axial direction, $V_z$ is the velocity of the electrons in the axial direction, s is the order of harmonics, $\Omega_c$ is the cyclotronic angular frequency of the electrons with consideration of relativistic effect.

$$\Omega_c = eB/\tau m_0 \tag{2}$$

where e is the electron charge (absolute value), B is the flux density in the cavity resonator in the axial direction, $\tau$ is a relativistic coefficient, and $m_0$ is the rest mass of electron.

The equation (1) implies that the energy of the electron beam is efficiently converted into high-frequency electromagnetic energy to generate a strong electromagnetic wave when the right-hand side of the equation (1) is slightly smaller than the left-hand side. The equations (1) and (2) indicate the necessity of a high-strength magnetic field in the resonant cavity 70 for the accomplishment of high-frequency oscillation at a sufficiently high frequency. Thus, for efficient operation of a gyrotron it is very important to produce a high-strength magnetic field with good accuracy.

A cylindrical magnet unit according to the invention can be used in place of the combination of the two electromagnets 64 and 68 in the gyrotron apparatus shown in FIG. 15.

Figure 8:
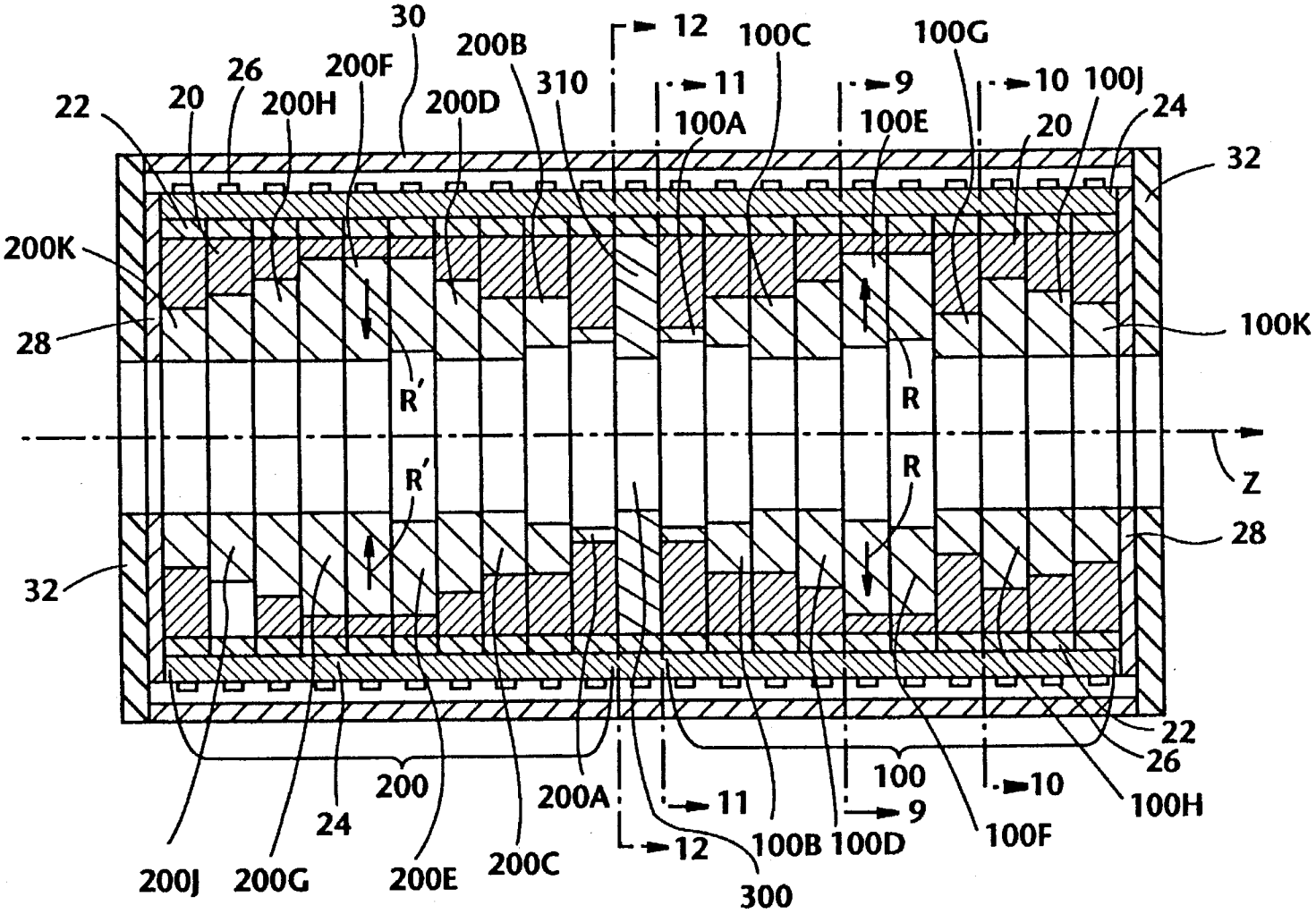
FIG. 8 is a longitudinal sectional view of an embodiment of a cylindrical magnet unit according to the invention.

FIG. 8 shows a cylindrical magnet unit embodying the present invention. This magnet unit has a first cylindrical permanent magnet 100 which is an assembly of ten ring-like permanent magnets 100A, 100B, . . . , 100K and a second cylindrical permanent magnet 200 which is an assembly of ten ring-like permanent magnets 200A, 200B, . . . , 200K. Each of these ring-like magnets 100A–100K, 200A–200K is constructed of a plurality of segments as described with reference to FIGS. 4 and 5. The two cylindrical magnets 100 and 200 are aligned on a center axis Z. There is a space 300 between the two cylindrical magnets 100 and 200, and a ring-like member 310 of a nonmagnetic material is inserted in this space 300. In the first cylindrical magnet 100 every ring-like magnet 100A–100K is magnetized in the radial directions R from the inside toward the outside. In the second cylindrical magnet 200 every ring-like magnet 200A–200K is magnetized in the radial directions R' from the outside toward the inside.

The ring-like magnets 100A–100K, 200A–200K respectively have various inner and outer diameters which are determined according to the desired distribution of flux density in the hole of the cylindrical magnet unit.

Backing members 20 are attached to the outside of each ring-like magnet 100A–100K, 200A–200K. Together with the backing members 20 each ring-like magnet is fitted into a ring-like retainer 22, and the retainer 22 is fixed to the backing members 20 by bolts 26. Supporting bars 24 are fixed, by the same bolts 26, to the outside of the ring-like retainer 22 for every ring-like magnet. The thickness of the backing members 20 for each ring-like magnet depends on the outer diameter of the ring-like magnet, and a ring-like retainer 22 having constant inner and outer diameters is used for every ring-like magnet. The nonmagnetic ring 310 is also fitted in the ring-like retainer 22. The supporting bars 24 are elongate in conformance with the total length of the cylindrical magnets 100 and 200 and the space 300 and serve the purpose of holding the ring-like magnets 100A–100K. 200A–200K in the juxtaposed arrangement.

An end plate 28 having a center hole is attached to the exposed end of the first cylindrical magnet 100 to resist against repulsive force acting on the ring-like magnet 100K from the axially inner ring-like magnets. For the same purpose, a similar end plate 28 is attached to the opposite end of the second cylindrical magnet 200. The assembly of the first and second cylindrical magnets 100, 200 is confined in a cylinder 30, and an end plate 32 having a center hole is fixed to each end of the cylinder 30. The cylinder 30 and the end plates 32 are magnetic shields made of a low-carbon steel for preventing flux leakage. The end plates 32 are made thicker than the shield cylinder 30 since flux leakage from the both ends of the cylindrical magnet unit is particularly serious. The cylinder 30 and the end plates 32 have some influences on the distribution of flux density in the cylindrical magnet unit. So, the influences are taken into consideration in designing the cylindrical magnet unit.

The insertion of the nonmagnetic ring 310 is an option, and it is possible to omit the nonmagnetic ring 310 to leave the space 300 wholly vacant.

All the ring-like magnets 100A–100K, 200A–200K in the cylindrical magnet unit can be made of the same magnet material. However, it is also possible to use different magnet materials for all or some of these ring-like magnets for the purpose of desirably adjusting the distribution of flux density in the cylindrical magnet unit. For example, some of the ring-like magnets are made of a ferrite magnet (about 1–4 MGOe) and the other of a rare earth magnet (12–45 MGOe). For the same purpose another measure is varying the degree of magnetization, i.e. residual magnetization, of all or some of the ring-like magnets 100A–100K, 200A–200K. Of course it is possible to combine the use of different magnet materals and the variations in residual magnetization.

Figure 9:
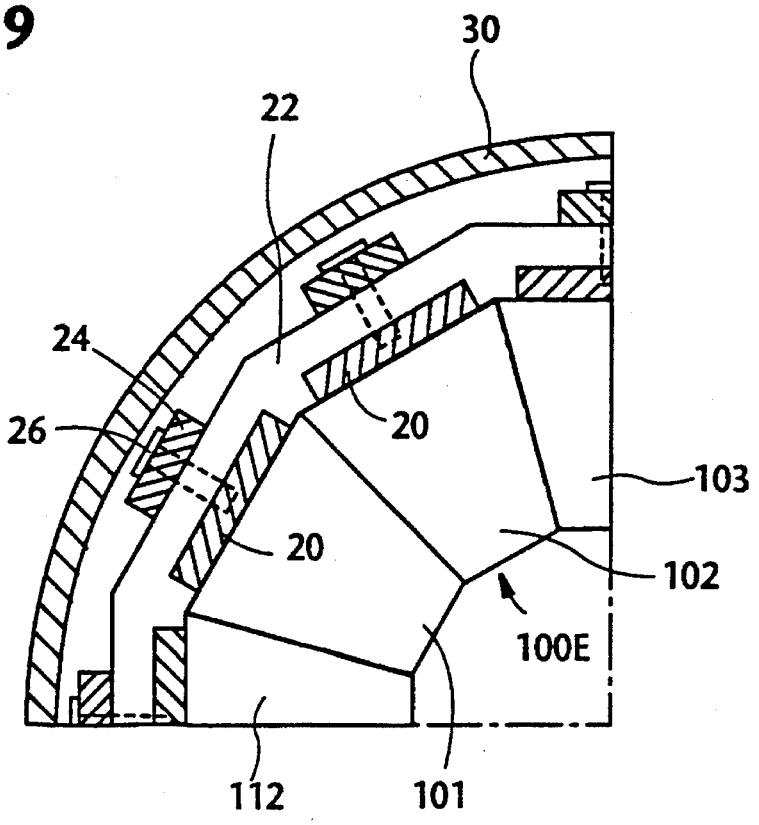
FIG. 9 is a quarter of a cross-sectional view taken along the line 9—9 in FIG. 8.

In this embodiment the ring-like magnets 100A–100K, 200A–200K are polygonal on both the outside and the inside. As an example, FIG. 9 shows a quarter of the ring-like magnet 100E constructed of 12 segments 101, 102, . . . , 112 each of which is a permanent magnet block. The circumferentially arranged segments 101, 102, . . . , 112 are fixed to one another with an adhesive after magnetizing each segment. The adhesive is used since to prevent displacement of segments by repulsive force between adjacent segments. A backing member 20 is fixed to the outside of each segment with an adhesive, and the assembly of the segments 101, 102, . . . , 112 and the backing members 20 is fitted in the ring-like retainer 22. Usually the backing members 20 are nonmagnetic. The retainer 22 is made of either a nonmagnetic material or a ferromagnetic material. Then the retainer 22 is fixed to the backing members 20, and simultaneously the supporting bars 24 are fixed to the retainer 22, by bolts 26. One of the reasons for using the backing members 20 is that drilling or grooving of the permanent magnet segments 101, 102, . . . , 112 is very difficult. Usually the permanent magnet material is selected from ferrite magnets (ceramics), rare earth magnets (intermetallic compounds), Fe-Al-Ni-Co magnets, Fe-Cr-Co magnets, Mn-Al-C magnets, etc. all of which are very difficult to machine. Another reason is the variations in the outer diameters of the ring-like magnets 100A–100K, 200A–200K as mentioned hereinbefore.

Figure 10:
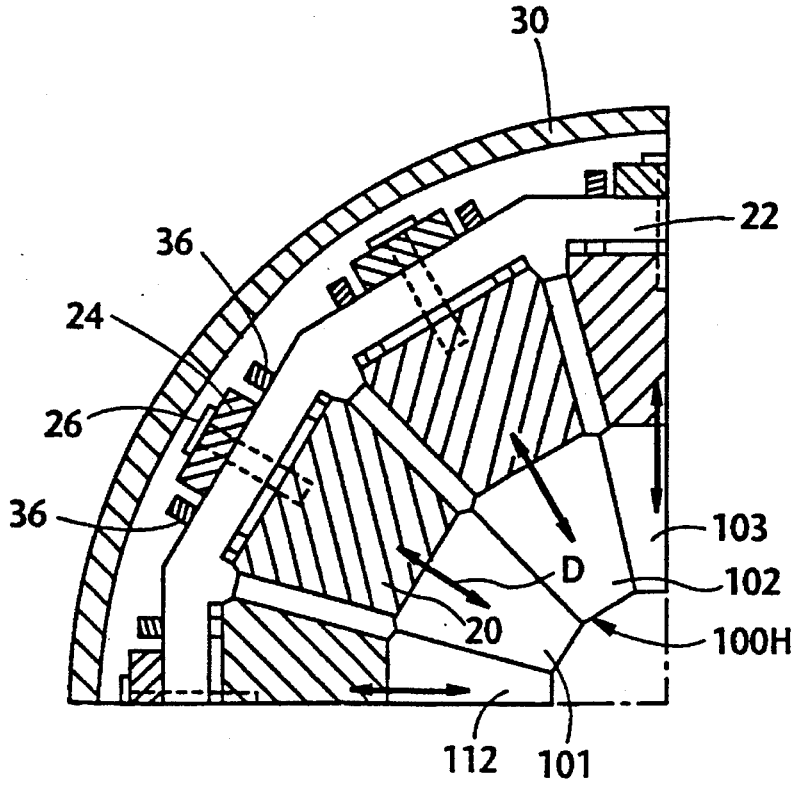
FIGS. 10 and 11 respectively show two optional modifications of the cylindrical magnet unit of FIGS. 8 and 9 each in a sectional view corresponding to FIG. 9.

For adjusting the distribution of flux density in the cylindrical magnet unit, it is an option to provide all or some of the ring-like magnets 100A–100K, 200A–200K with a mechanism to slightly move the segments of each ring-like magnet in radial directions. FIG. 10 shows a simple embodiment of such mechanism with respect to the ring-like magnet 100H by way of example. Each of the permanent magnet segments 101, 102, . . . , 112 is bonded to a backing member 20 with an adhesive, and the backing member 20 is attached to the ring-like retainer 22 by the bolt 26. The supporting bars 24 are also attached to the retainer 22. In addition, screws 36 are attached to the backing member 20 on each magnet segment 101, 102, . . . , 112 by using through-holes bored in the retainer 22. Each backing member 20 (together with the magnet segment bonded thereto) can be pushed radially inward by turning the screws 36 and pulled radially outward by turning the bolt 26. Alternatively the bolt 26 is used for pushing the backing member 20 and the screws 36 for pulling. The arrows D indicate the directions of the movement of each magnet segment together with the backing member 20. The moving of the magnet segments can be performed before assembling the cylindrical magnet 100 or 200 or after assembling the cylindrical magnet 100 or 200, or even after assembling the cylindrical magnet unit (but before fitting the magnet unit in the cylinder 30). The main purpose of moving the magnet segments 101, 102, . . . , 112 is for minutely adjusting the distribution of flux density. Besides, at the stage of inserting a gyrotron body in the cylindrical magnet unit it is possible to move the magnet segments of all or some of the ring-like magnets radially outward to temporarily enlarge the inner diameters of the cylindrical magnet unit for convenience to the inserting operation. After inserting the gyrotron body, the magnet segments are moved to the initial positions.

Figure 11:
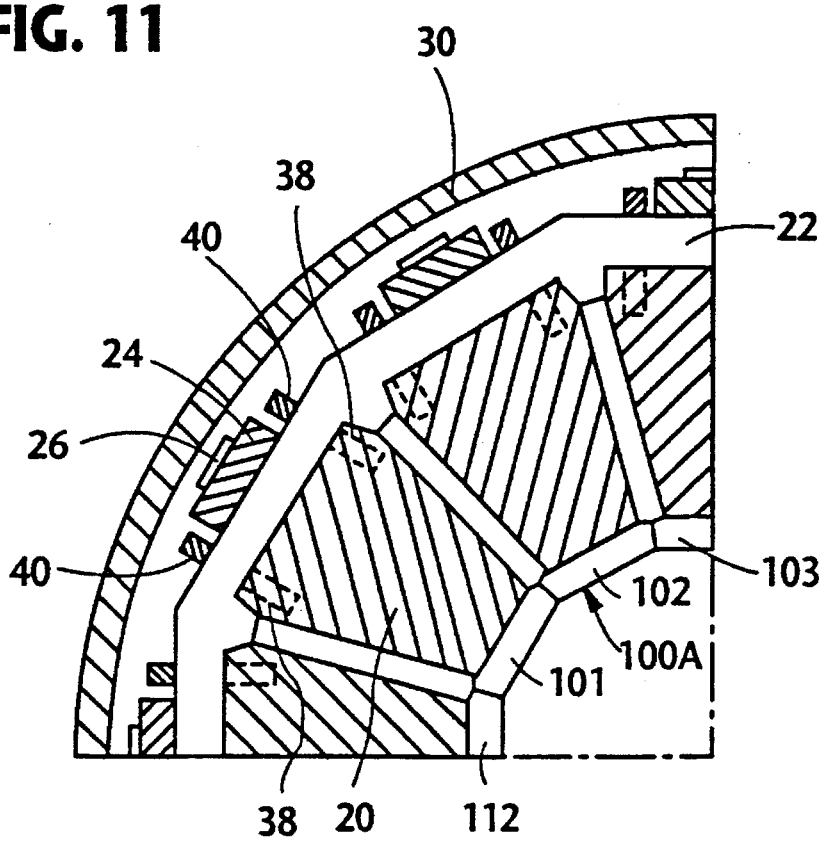

As another option, FIG. 11 illustrates a means to minutely adjust the distribution of flux density after assembling the cylindrical magnet 100 or 200. The ring-like magnet 100A is taken by way of example. The permanent magnet segments 101, 102, . . . , 112, backing members 20, ring-like retainer 22 and the supporting bars 24 are assembled in the same manner as in the case of the ring-like magnet 100E in FIG. 9. Besides, threaded holes 38 are bored in each backing member 20 via through-holes in the ring-like retainer 22, and threaded rods 40 of a ferromagnetic material or a permanent magnet are screwed into the threaded holes 38. For minute adjustment of the distribution of flux density in the cylindrical magnet, the amount of insertion of the rods 40 into the holes 38 is varied. The holes 38 are directed approximately toward the center axis Z. The adjusting rods 40 in FIG. 11 and the moving mechanism of FIG. 10 are not employed together.

Figure 12:
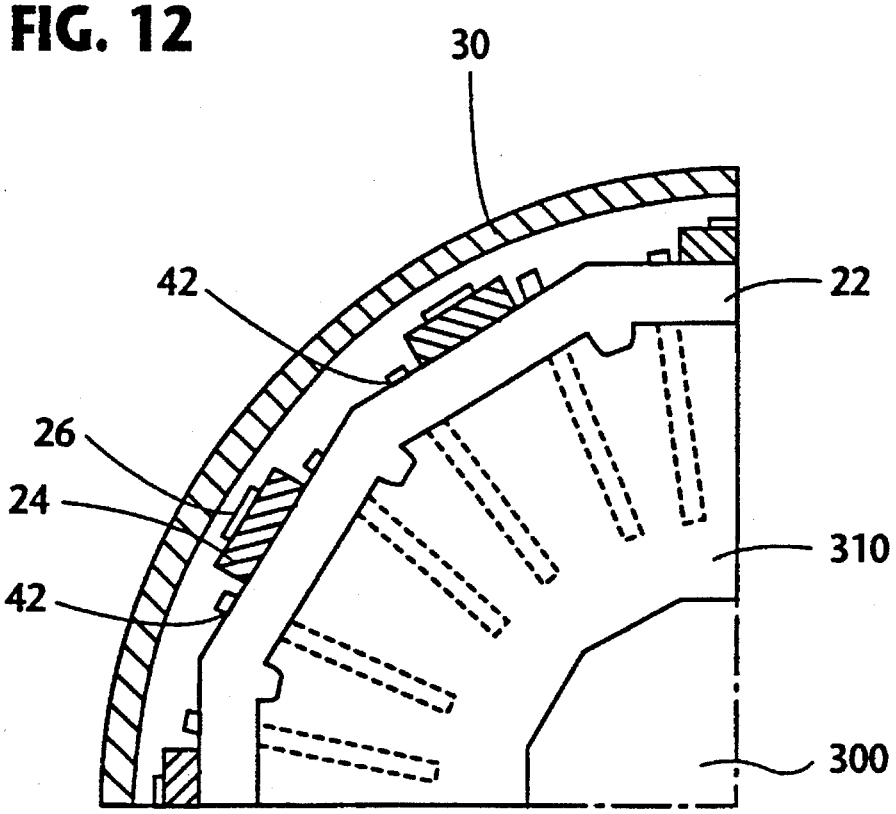
FIG. 12 is a quarter of a cross-sectional view taken along the line 12—12 in FIG. 8.

Referring to FIG. 12, the nonmagnetic ring 310 and the supporting bars 24 are fixed to the ring-like retainer 22 by bolts 26. The retainer 22 for the nonmagnetic ring 310 may be either nonmagnetic or magnetic. As an option, threaded rods 42 of a ferromagnetic material or a permanent magnet are screwed into threaded holes 44 bored in the nonmagnetic ring 310 via through-holes in the retainer 22. The amount of insertion of the rods 42 into the holes 44 is varied to minutely adjust the distribution of flux density in the middle section of the cylindrical magnet unit.

Figure 13:
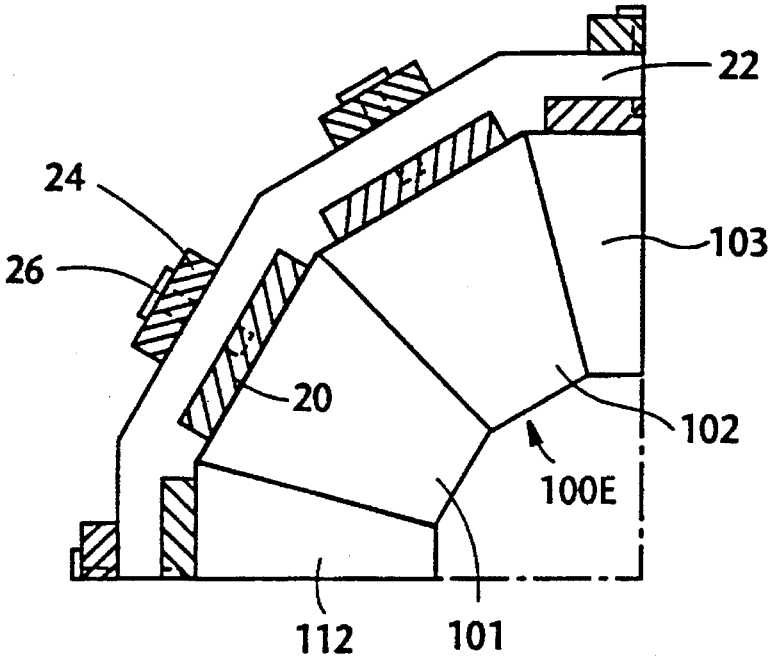
FIG. 13 shows the omission of a cylindrical shield from the cylindrical magnet unit of FIGS. 8 and 9.

The shield cylinder 30 is not an essential part of the cylindrical magnet unit. The cylinder 30 can be omitted as shown in FIG. 13 with the effect of reducing the weight of the magnet unit. When the cylinder 30 is omitted, a ferromagnetic material such as low-carbon steel is used as the material of the backing members 20 for every ring-like magnet 100A–100K, 200A–200K.

Figure 14:
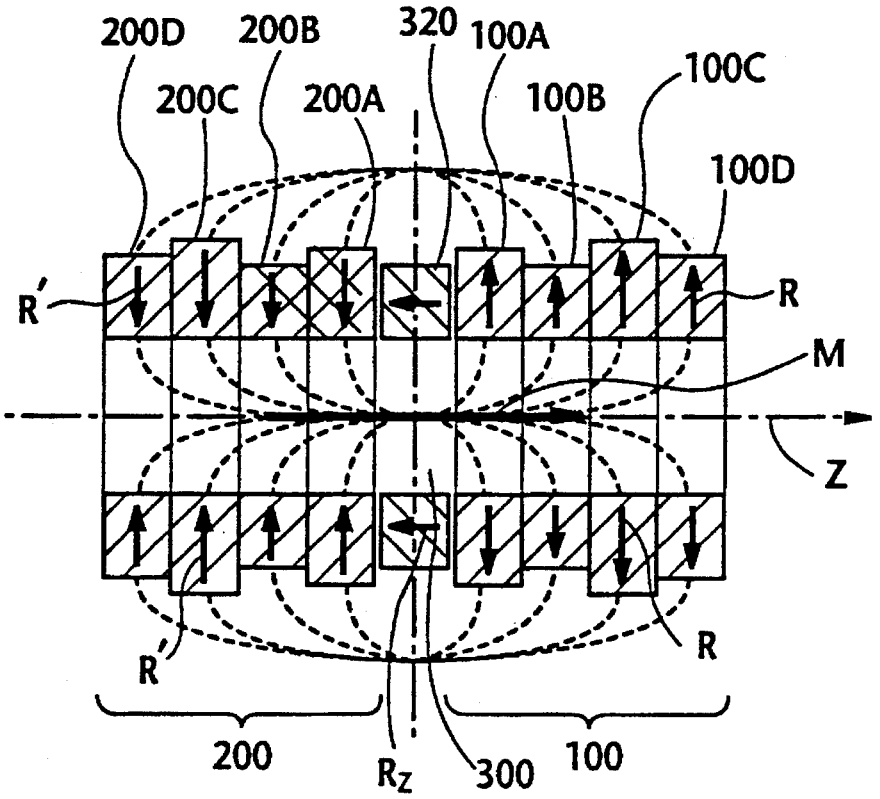
FIG. 14 shows the fundamental construction of another cylindrical magnet unit according to the invention in a longitudinal sectional view.

FIG. 14 shows another modification of the fundamental construction of a cylindrical magnet unit 10 according to the invention. In this case a ring-like permanent magnet 320 is placed in the space 300 between the first and second cylindrical magnets 100 and 200. The ring-like permanent magnet 320 is magnetized, as indicated by arrow $R_z$ in a direction parallel to the center axis Z of the tubular magnet unit 10. In FIG. 14 there is a narrow gap between the ring-like permanent magnet 320 and each of the two cylindrical magnets 100 and 200. This is preferable but is not essential. The ring-like magnet 320 may be in contact with either or both of the two cylindrical magnets 100 and 200. A thin plate (not shown) of a ferromagnetic material may be inserted into the gap between the magnet 320 and each, or either, of the two cylindrical magnets 100 and 200 for minute adjustment of the distribution of flux density in the middle section of the cylindrical magnet unit 10.

What is claimed is:

1. A cylindrical permanent magnet unit suitable for application to gyrotrons, comprising:

a first cylindrical permanent magnet which is an assembly of a plurality of coaxially juxtaposed ring-like permanent magnets each of which is magnetized in approximately radial directions from the inside toward the outside;

a second cylindrical permanent magnet which is an assembly of a plurality of coaxially juxtaposed ring-like permanent magnets each of which is magnetized in approximately radial directions from the outside toward the inside, wherein the first and second cylindrical permanent magnets are longitudinally aligned to have a common center axis and to provide a space between the first and second tubular magnets, each of the ring-like permanent magnets of the first and second cylindrical permanent magnets being constructed of a plurality of segments arranged around a circumference, each of said segments being a permanent magnet magnetized in an approximately radial direction with respect to said circumference;

a ring-like member of a nonmagnetic material which is inserted in the space between the first and second cylindrical permanent magnets; and a plurality of elongate pieces of a ferromagnetic material which are adjustably inserted into said ring-like member in approximately radial directions from the outside.

2. A magnet unit according to claim 1, wherein the elongate pieces of the ferromagnetic material are permanent magnets.

3. A magnet unit according to claim 1, wherein at least one of the ring-like permanent magnets in the first and second cylindrical permanent magnets comprises a mechanical means for moving said plurality of segments individually in radial directions.

4. A magnet unit according to claim 1, wherein at least one of the ring-like permanent magnets in the first and second cylindrical permanent magnets differs in magnet material from at least one of the others.

5. A magnet unit according to claim 1, wherein at least one of the ring-like permanent magnets in the first and second cylindrical permanent magnets differs in either or both of the inner and outer diameters from at least one of the others.

6. A magnet unit according to claim 1, wherein at least one of the ring-like permanent magnets in the first and second cylindrical permanent magnets differs in residual magnetization from at least one of the others.

7. A magnet unit according to claim 1, wherein at least one of the ring-like permanent magnets in the first and second cylindrical permanent magnets is spaced from an adjacent ring-like permanent magnet to provide a narrow gap.

8. A magnet unit according to claim 7, wherein said gap is filled with a sheet of a nonmagnetic material.

9. A cylindrical permanent magnet unit suitable for application to gyrotrons, comprising:

a first cylindrical permanent magnet which is an assembly of a plurality of coaxially juxtaposed ring-like permanent magnets each of which is magnetized in approximately radial directions from the inside toward the outside;

a second cylindrical permanent magnet which is an assembly of a plurality of coaxially juxtaposed ring-like permanent magnets each of which is magnetized in approximately radial directions from the outside toward the inside, wherein the first and second cylindrical permanent magnets are longitudinally aligned to have a common center axis and to provide a space between the first and second tubular magnets, each of the ring-like permanent magnets of the first and second cylindrical permanent magnets being constructed of a plurality of segments arranged around a circumference, each of said segments being a permanent magnet magnetized in an approximately radial direction with respect to said circumference; and an auxiliary ring-like permanent magnet which is inserted in the space between the first and second cylindrical permanent magnets and is magnetized in a direction parallel to said center axis.

10. A magnet unit according to claim 9, wherein said auxiliary ring-like permanent magnet is spaced from at least one of the first and second cylindrical permanent magnets.

11. A magnet unit according to claim 9, wherein at least one of the ring-like permanent magnets in the first and second cylindrical permanent magnets comprises a mechanical means for moving said plurality of segments individually in radial directions.

12. A magnet unit according to claim 9, wherein at least one of the ring-like permanent magnets in the first and second cylindrical permanent magnets differs in magnet material from at least one of the others.

13. A magnet unit according to claim 9, wherein at least one of the ring-like permanent magnets in the first and second cylindrical permanent magnets differs in either or both of the inner and outer diameters from at least one of the others.

14. A magnet unit according to claim 9, wherein at least one of the ring-like permanent magnets in the first and second cylindrical permanent magnets differs in residual magnetization from at least one of the others.

15. A magnet unit according to claim 9, wherein at least one of the ring-like permanent magnets in the first and second cylindrical permanent magnets is spaced from an adjacent ring-like permanent magnet to provide a narrow gap.

16. A magnetic unit according to claim 15, wherein said gap is filled with a sheet of a nonmagnetic material.

17. A cylindrical permanent magnet unit suitable for application to gyrotrons, comprising:

a first cylindrical permanent magnet which is an assembly of a plurality of coaxially juxtaposed ring-like permanent magnets each of which is magnetized in approximately radial directions from the inside toward the outside;

a second cylindrical permanent magnet which is an assembly of a plurality of coaxially juxtaposed ring-like permanent magnets each of which is magnetized in approximately radial directions from the outside toward the inside, wherein the first and second cylindrical permanent magnets are longitudinally aligned to have a common center axis and to provide a space between the first and second tubular magnets, each of the ring-like permanent magnets of the first and second cylindrical permanent magnets being constructed of a plurality of segments arranged around a circumference, each of said segments being a permanent magnet magnetized in an approximately radial direction with respect to said circumference; and at least one of the ring-like permanent magnets in the first and second cylindrical permanent magnets comprises a plurality of elongate pieces of a ferromagnetic material which are adjustably inserted into the respective segments of the ring-like permanent magnet in approximately radial directions from the outside.

18. A magnet unit according to claim 17, wherein the elongate pieces of the ferromagnetic material are permanent magnets.

19. A magnet unit according to claim 17, wherein at least one of the ring-like permanent magnets in the first and second cylindrical permanent magnets comprises a mechanical means for moving said plurality of segments individually in radial directions.

20. A magnet unit according to claim 17, wherein at least one of the ring-like permanent magnets in the first and second cylindrical permanent magnets differs in magnet material from at least one of the others.

21. A magnet unit according to claim 17, wherein at least one of the ring-like permanent magnets in the first and second cylindrical permanent magnets differs in either or both of the inner and outer diameters from at least one of the others.

22. A magnet unit according to claim 17, wherein at least one of the ring-like permanent magnets in the first and second cylindrical permanent magnets differs in residual magnetization from at least one of the others.

23. A magnet unit according to claim 17, wherein at least one of the ring-like permanent magnets in the first and second cylindrical permanent magnets is spaced from an adjacent ring-like permanent magnet to provide a narrow gap.

24. A magnetic unit according to claim 23, wherein said gap is filled with a sheet of a nonmagnetic material.

* * * * *